United States Patent [19]

Ciccotelli

[11] Patent Number: 4,689,029

[45] Date of Patent: Aug. 25, 1987

[54] SWIM FIN

[76] Inventor: Stephen S. Ciccotelli, P.O. Box 1414, Deming, N. Mex. 88031

[21] Appl. No.: 842,282

[22] Filed: Mar. 21, 1986

[51] Int. Cl.[4] ..... A63B 31/10

[52] U.S. Cl. ..... 441/64

[58] Field of Search ..... 441/60–64

[56] References Cited

U.S. PATENT DOCUMENTS

| | | | |
|---|---|---|---|
| 3,302,223 | 2/1967 | Ciccotelli | 441/64 |
| 4,209,866 | 7/1980 | Loeffler | 441/64 |

FOREIGN PATENT DOCUMENTS

| | | | |
|---|---|---|---|
| 1245395 | 9/1960 | France | 441/64 |
| 1322734 | 2/1963 | France | 441/64 |
| 676938 | 11/1964 | Italy | 441/64 |

*Primary Examiner*—Joseph F. Peters, Jr.
*Assistant Examiner*—Jesûs D. Sotelo
*Attorney, Agent, or Firm*—Cahill, Sutton & Thomas

[57] ABSTRACT

An improved swim fin includes a foot pocket, first and second flexible beams supported by the pocket and projecting forwardly from it, first and second struts attached securely to outer ends of the first and second flexible beams, respectively, a narrow, rigid, streamlined blade having a large span rigidly attached to outer ends of the first and second struts. The first and second flexible struts are composed of flexible plastic and have elliptical cross-sections to reduce drag and to prevent twisting. The first and second struts form legs of a U-shaped member, the bottom of which forms a cross-member maintaining spacing between the first and second flexible beams at a fixed value.

5 Claims, 4 Drawing Figures

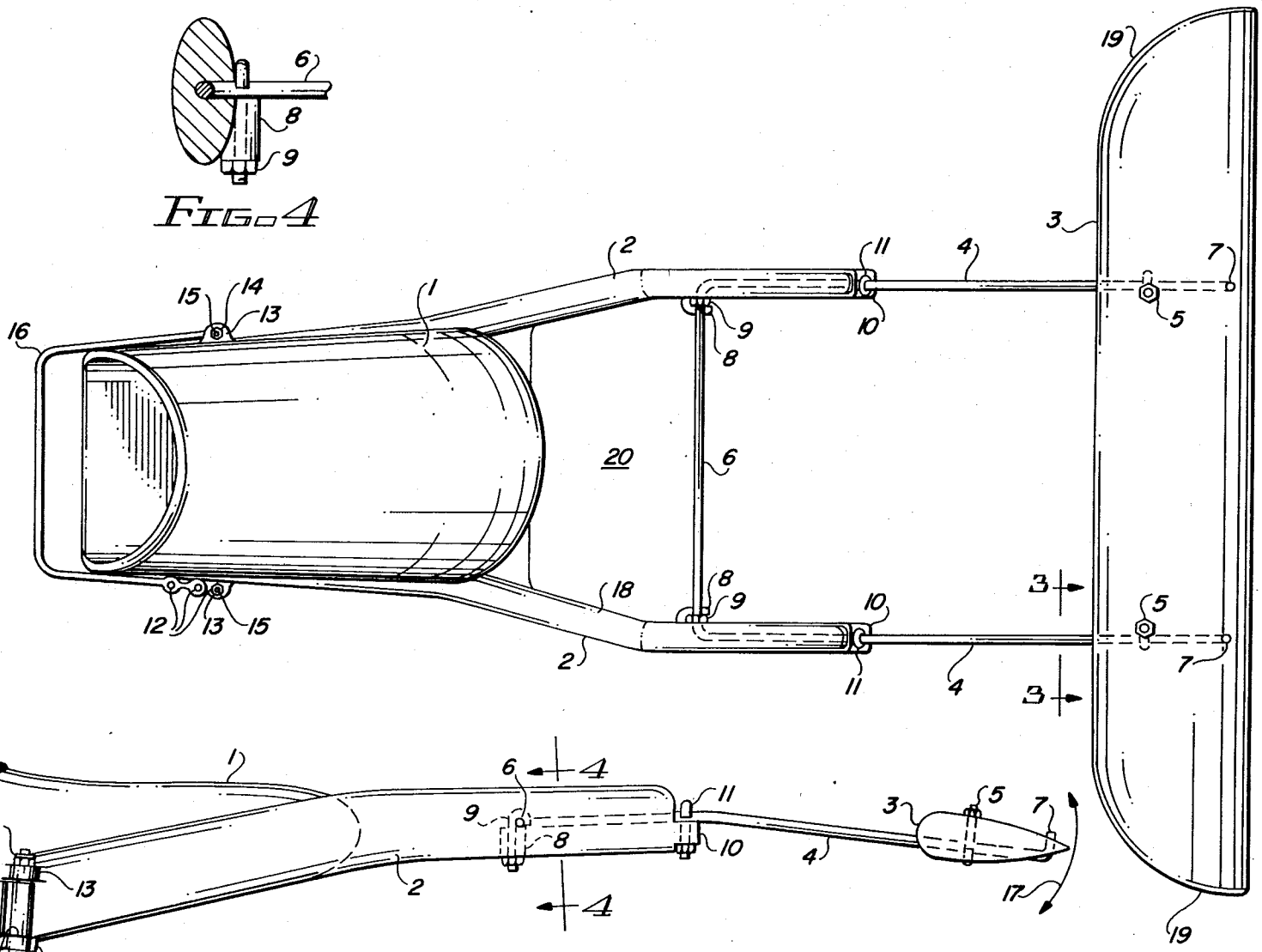
Fig. 1
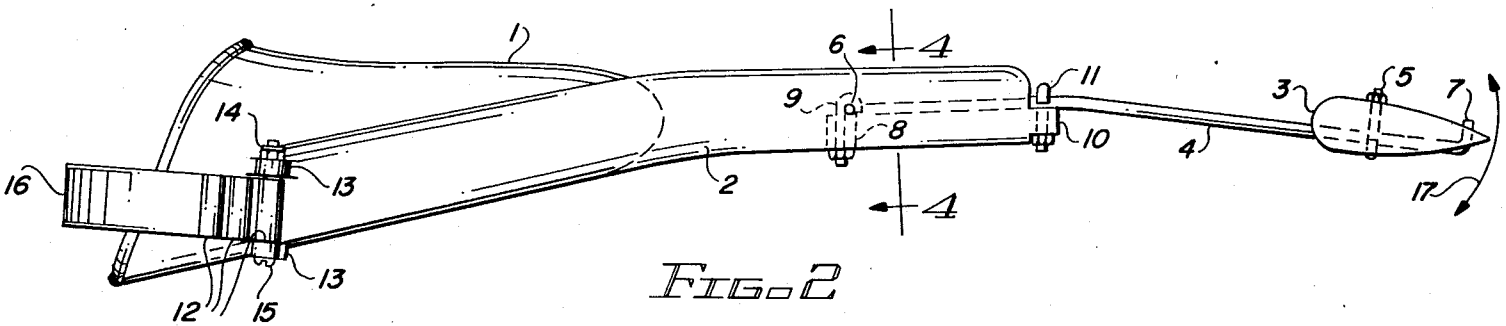
Fig. 2
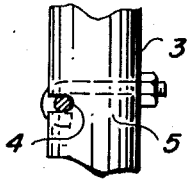
Fig. 3
Fig. 4

SWIM FIN

The present invention relates to improvements in swim fins.

A principal objective of the invention is to provide a swim fin with greater efficiency.

Swim fins that are currently being manufactured comprise three basic components; namely, a foot pocket, two flexible beams that project from the sides of the foot pocket and a flexible blade. Each lateral side of the blade is attached to a flexible beam and the side of the blade that is adjacent to the foot pocket is attached to the toe area of the foot pocket.

Supporting the blade in this manner creates an impediment to the flow of water to the blade. It is an object of this invention to support the blade in a way that minimizes entry losses of water flowing to the blade surface.

Since the blade angle of a swim fin must reverse itself at the end of each stroke, a considerable amount of energy is expended by the conventional swim fin because of the drag generated by the blade surface near the foot pocket. It is an object of my invention to eliminate this surface.

Another feature of the conventional swim fin that wastes energy during blade reversal is the long blade. It is an object of my invention to provide a swim fin with a rigid blade that is narrow, has a large blade span and has a comparatively small blade area thereby reducing to a minimum both the quantity and the velocity of the water that is moved during blade angle reversal.

A further object of this invention is to provide a suspension system; which can support a rigid blade that is positioned so that a large space exists between the foot pocket and the blade; which confines the flexing of the flexible beams to an area that is located near the foot pocket; which permits the blade to be angled to a greater extent with respect to the foot pocket than the flexible beams; which permits the blade to reverse its blade angle easily at the end of each stroke; which resists excessive deflection on a hard kick by the swimmer; which provides a simple means for attaching a blade having a streamlined cross section; and finally, which does all of the above with parts having a low drag profile.

Further objects and advantages of my invention will appear as the specification proceeds.

The preferred form of my invention is illustrated in the accompanying drawings in which:

FIG. 1 is a plan view of my swim fin.

FIG. 2 is a side view of the swim fin of FIG. 1.

FIG. 3 is a section view taken along section line 3—3 of FIG. 1.

FIG. 4 is a section view taken along section line 4—4 of FIG. 2.

While I have shown the preferred form of my invention, I wish to have it understood that various changes and modifications may be made within the scope of the claims hereto attached without departing from the spirit of the invention.

Referring to the drawings in detail, my swim fin comprises a foot pocket 1 with two flexible beams 2 projecting from it, a narrow rigid blade 3 having a streamlined cross-section and a large blade span.

The rigid blade 3 has two grooves, one of which is illustrated in the partial section view of FIG. 3, in which two struts 4 which project from the blade 3 are clamped to the blade by hook-shaped fasteners 5. The struts are joined at their extremities by a cross-member 6. The struts and cross-member are made as a one-piece U-shaped wire form, and the ends of the struts are bent 90° so that they can be inserted into holes 7 in the blade.

The wire form is made of corrosion-resistant high strength wire such as stainless steel, spring wire having a diameter of approximately 5/32 of an inch in diameter.

Each of the flexible beams 2 has a groove to accept part of the wire form. The groove is illustrated in the section view of FIG. 4. Because of their length and flexibility, designing the flexible beams 2 to provide a suitable means to attach the U-shaped wire form while at the same time to provide a flexible beam which generates a minimum amount of drag is a primary object of this invention. In my swim fin the flexible beam 2 is given an elliptical cross-section having a low drag profile, illustrated in the section view of FIG. 4. This configuration generates a minimum amount of drag on both the up stroke as well as the down stroke.

The dimensions of the elliptical cross-section of the flexible beams at a point near the foot pocket is approximately 1.500 by 0.640. A larger cross-section would be required for stiffer models. The flexible beams are made of flexible plastic and graphite or glass fibers may be added to the plastic to increase stiffness and strength. The flexible beams have to be stiff enough to prevent excessive deflection of the blade on a hard kick by the swimmer otherwise a loss of thrust will result.

Placing the strut in a groove which positions the strut on the center line of the flexible beam 2 reduces the tendency of the flexible beam to twist. To further reduce the tendency of the flexible beams 2 to twist, each of the flexible beams 2 has a boss 8, illustrated in the section view of FIG. 4, projecting from the flexible beam 2 to which the cross-member 6 of the wire form is clamped by hook-shaped fasteners 9. Also, each of the flexible beams 2 has a boss 10 located at its extremity to which a strut 4 is clamped by hook-shaped fasteners 11.

The operation of my swim fin is as follows: Referring to FIG. 2, during swimming, the trailing end of the blade 3 deflects alternately in one direction and then the other describing an arc-shaped path 17 illustrated in FIG. 2. Because the struts 4 of the wire form deflect only a little, the parts 18 of the flexible beams 2 located between the cross-member 6 and the foot pocket 1 are forced to flex; thus, giving the blade 3 a hinging action which is located far enough away from the blade 3 to provide good finning performance.

The struts 4 are bent so as to angle the blade 3 to a greater extent with respect to the foot pocket 1 than the flexible beams 2. This is an important point for efficient operation of the blade 3 because it positions the blade 3 closer to the desired blade angle in which, during swimming, the blade deflects about as much on the down stroke as on the up stroke.

One of the areas of this swim fin design which is responsible for a substantial gain in efficiency is the design of the blade 3. The leading edge of the blade 3 is swept back at the tip area to the trailing edge, as indicated by reference numeral 19. This is done primarily to remove the 90° corners. The two inside corners or tip areas tend to strike each other during swimming unless removed. Also, tapering the tip area reduces tip losses. The blade 3 has a streamlined cross-section, as indicated in FIG. 2, which reduces drag to a minimum. Lift and drag for this type of blade have been well documented over the years. But in order to develop a high degree of efficiency with this type of blade, it is necessary to have a narrow blade with a large blade span. In the drawing is illustrated a blade measuring only 3 inches from the leading edge to the trailing edge, and having a blade span of 18 inches. The blade area is 51 square inches, and yet develops adequate thrust. Also the blade is stable and requires no stabilizer surfaces. Using a blade of these dimensions runs contrary to current swim fin design practice in which the blade measures about 11 inches measured from the toe of the foot pocket to the end of the blade and about 9 inches measured across the blade.

To achieve maximum efficiency, the blade 3 is positioned so that there is a large open space 20 between the foot pocket 1 and the blade 3. In my swim fin, this distance is 11 inches. There are two suspension systems capable of supporting and providing good finning action for a rigid blade such as blade 3 that is located at a point so far from the foot pocket. One is the suspension system described in this specification and the other is one for which I recently applied for a patent, Ser. No. 798,676, entitled "SWIM FIN", filed on Nov. 15, 1985, and incorporated herein by reference. Both systems require a U-shaped wire form. They differ mainly in two points:

1. The U-shaped wire form described in this specification is fixedly attached at two points to each flexible beam, whereas the cross-member of the U-shaped wire form in the design of my prior patent application acts as a hinge pin and is pivotally attached to each flexible beam.

2. The flexible beams described in this specification are short whereas the flexible beams in the design of my prior patent application extend all the way to the blade to which they are attached. The suspension system in this specification generates substantially less drag.

Another area of the swim fin that has been improved is the heel strap 16 and the means to attach it to the foot pocket. To reduce the drag profile of the heel strap and the bosses on the foot pocket to which it is attached, the heel strap 16 has a long hole in one end and a series of long holes 12 in the other end. The foot pooket has two bosses 13 on each side having a hole to accept a fastener 15 which has a threaded end. A fastener 15, on each side of the foot pocket is inserted into a hole in the heel strap. A stop nut 14 completes the means to attach the heel strap to the foot pocket.

A long strap is supplied when a new pair of fins is purchased. After the swimmer has adjusted the strap length for his foot size, the excess strap length is cut off.

I claim:

1. A swim fin comprising in combination:

a foot pocket;

first and second flexible beams projecting from the foot pocket;

a rigid blade;

first and second struts;

means for fixedly attaching the first and second struts to the first and second flexible beams respectively so that part of the first and second struts project forward from the ends of the first and second flexible beams, respectively, the ends of the first and second struts being connected by a cross-member, the first and second struts and the cross-member being formed as a one-piece U-shaped wire form; and means for attaching the outer end portions of the first and second struts to the rigid blade.

2. The swim fin of claim 1 including means for fixedly attaching the cross-member and the first and second struts to inner portions of the first and second flexible beams, respectively.

3. The swim fin of claim 2 wherin the part of the first and second struts of the U-shaped wire form that projects from the flexible beams are angled with respect to the first and second flexible beams.

4. The swim fin of claim 2 wherein the outer ends of the first and second struts each are bent 90° for insertion into first and second holes, respectively, in the blade, the blade having first and second grooves for receiving the first and second struts, respectively, and third and fourth holes for receiving first and second hook-shaped fasteners clamping the first and second struts, respectively, into the first and second grooves of the rigid blade, each of the first and second flexible beams having a groove to accept part of the wire form, and each of the first and second flexible beams having a boss projecting from its inner side with a hole therein for receiving a hook-shaped fastener clamping the cross-member to that boss, each of the first and second flexible beams having another boss located at the extremity of that flexible beam with a hole therein for receiving a hook-shaped fastener to clamp one of the first and second struts to that boss.

5. The swim fin of claim 4 including a heel strap having a long hole in one end and a series of long holes in the other end, the foot pocket having a low drag profile boss on each side of the foot pocket, each of the low drag profile bosses having a hole therein to accept a fastener having a threaded end, the fastener on each side of the foot pocket extending through a hole in one of the heel strap and the hole in the corresponding low drag profile boss and having a stop nut thereon to secure the heel strap to the low profile bosses.

* * * * *